US006987445B1

(12) United States Patent
Burnett et al.

(10) Patent No.: US 6,987,445 B1
(45) Date of Patent: Jan. 17, 2006

(54) WATER RESISTANT AUDIBLE SIGNAL

(75) Inventors: George A. Burnett, Clayton, IN (US); Joshua K. Brown, Indianapolis, IN (US); Daniel W. O'Brien, Mooresville, IN (US)

(73) Assignee: Mallory Sonalert Products, Inc., Indianapolis, IN (US)

( * ) Notice: Subject to any disclaimer, the term of this patent is extended or adjusted under 35 U.S.C. 154(b) by 0 days.

(21) Appl. No.: 09/667,981

(22) Filed: Sep. 22, 2000

(51) Int. Cl.
*G08B 3/00* (2006.01)

(52) U.S. Cl. ..... 340/387.1; 340/384.1; 340/384.6; 340/693.5; 340/692; 381/189; 381/190; 381/345; 381/386; 381/391; 381/395; 367/162; 367/163

(58) Field of Classification Search ..... 340/387.1, 340/384.6, 384.1, 693.5
See application file for complete search history.

(56) References Cited

U.S. PATENT DOCUMENTS 3,987,258 A * 10/1976 Tsutsui et al. ..... 381/334
4,028,504 A * 6/1977 Massa ..... 179/146 R
4,042,845 A * 8/1977 Hackett ..... 310/322
4,413,198 A * 11/1983 Bost ..... 310/324
4,420,706 A * 12/1983 Siebold et al. ..... 310/324
4,700,177 A * 10/1987 Nakashima et al. ..... 340/388
4,931,765 A * 6/1990 Rollins et al. ..... 340/407
4,949,386 A * 8/1990 Hill ..... 381/349
4,987,597 A * 1/1991 Haertl ..... 381/69
5,196,755 A * 3/1993 Shields ..... 310/324
5,218,634 A * 6/1993 Lee ..... 379/375
5,222,050 A * 6/1993 Marren et al. ..... 367/163
5,228,228 A 7/1993 Meissner ..... 43/17
5,420,570 A * 5/1995 Leitten et al. ..... 340/574
5,550,921 A * 8/1996 Freadman ..... 381/24
5,675,312 A * 10/1997 Burnett ..... 340/384.72
5,707,757 A * 1/1998 Lee ..... 429/86
5,726,626 A 3/1998 Jabbour et al. ..... 340/407.1
5,825,280 A 10/1998 Merendini et al. ..... 340/326
5,898,363 A * 4/1999 Altilio ..... 340/384.1
5,990,784 A 11/1999 Burnett ..... 340/384.7
6,064,909 A * 5/2000 Barkley et al. ..... 607/5
6,105,214 A * 8/2000 Press ..... 24/389
6,512,834 B1 * 1/2003 Banter et al. ..... 381/386
6,545,594 B1 * 4/2003 Knight et al. ..... 340/384.7

* cited by examiner

*Primary Examiner*—Benjamin C. Lee
(74) *Attorney, Agent, or Firm*—Niro, Scavone, Haller & Niro

(57) ABSTRACT

The invention is an modified audible signal, such as a piezoelectric noise-making and audible signaling device, which further includes a hydrophobic covering material, such as polytetrafluoroethylene (PTFE). The hydrophobic covering material is known to be water resistant, but does not effect the sound of the audible signaling device, thereby delaying or preventing the failure of the audible signaling device from water corrosion.

10 Claims, 2 Drawing Sheets

WATER RESISTANT AUDIBLE SIGNAL

BACKGROUND OF THE INVENTION

The present invention relates to an improved audible signal to provide audible alarms in a wide variety of devices including, for example, automobiles and trucks, industrial equipment, medical devices, traffic signals, appliances and the like. Such devices can use a piezoelectric transducer and associated circuitry to produce sound at a given frequency. The transducer flexes in response to an applied voltage. If an oscillating voltage is applied to the transducer at an appropriate rate, the flexing of the transducer produces an audible sound of substantial volume. As the wide variety of potential uses shown above suggests, these audible signals need to be able to operate in a wide variety of conditions and environments. One problem facing such audible signals is water corrosion. Audible signals have always had a problem with liquids being able to gather in the front of the housing. Once the front of the audible signal housing fills with liquid, it is only a matter of time before the transducer corrodes and failures occur. In addition, the audible signal cannot emit a sound if there is an accumulation of liquid sitting on the transducer. Currently, audible alarms containing a piezoelectric transducers must be turned upside down to protect them from buildups of liquid in the front of the housing.

What is needed is an audible signal which includes a barrier against liquids, while at the same time generating a signal that is not dampened in decibel level by the barrier.

In the invention, the audible signal is sealed by a hydrophobic material, such as polytetrafluoroethylene (PTFE). Typically, a disc of such material can be suitably attached to the audible signal by means of a hot melt, sonic weld, silicone adhesive, or similar fastening means. Such a hydrophobic material will result in an audible signal which is at least water resistant, while not materially affecting the decibel level or tone of the audible signal.

SUMMARY OF THE INVENTION

According to the invention, there is provided a piezoelectric transducer and associated electrical circuitry to cause the transducer to oscillate at a resonant audible frequency. U.S. Pat. No. 5,990,784 "Schmitt Trigger Loud Alarm With Feedback," is incorporated by reference herein and describes an alarm device using a piezoelectric transducer, and the circuitry used to perform such function. This patent is owned by the assignee of the present invention. Typically, the housing of the transducer is hollow, and can include multiple sections with different diameters. The sound generated by the piezoelectric element and amplified within the chambers or cavities of the housing preferably are emitted through a grill or spaces within the last cavity. One example of such a configuration, which is incorporated by reference, is shown in U.S. patent application Ser. No. 09/488,693, entitled "Extra Loud Low Frequency Acoustical Alarm Assembly," which was filed Jan. 20, 2000 and is assigned to the assignee of the present invention.

In this housing configuration, the transducer is mounted to a proximal tubular housing which is hollow, thus providing a first cavity. A second or distal tubular housing forms a second cavity adjoining the first cavity, and is of larger diameter than the first cavity. A third cavity adjoining the second cavity may optionally be employed. Sound is produced by the transducer and passes through the first cavity, second cavity and, if used, the third cavity. The sound is emitted through a grill on the last cavity. The present invention adds to this housing configuration by adding a hydrophobic material (such as PTFE) which is attached to the front of the audible signal housing in order to block out, or at least resist any liquids from accumulating, while avoiding any significant dampening of the decibel level of the alarm signal.

The following terms are used in the claims of the patent as filed and are intended to have their broadest meaning consistent with the requirements of law.

A "front face" can include a front surface, grill or aperture through which sound generated by a piezoelectric transducer is designed to pass.

A "water resistant, sound permeable barrier adjacent the front face" can include a covering which is affixed to a front face surface or grill of a sound amplifying housing, and it can also include a hydrophobic, sound permeable surface affixed to the aperture defining the front face.

Where alternative meanings are possible, the broadest meaning is intended. All words used in the claims set forth below are intended to be used in the normal, customary usage of grammar and the English language.

DETAILED DESCRIPTION OF THE INVENTION

Set forth below is a description of what is currently believed to be the preferred embodiment or best example of the invention claimed. Future and present alternative and modifications to this preferred embodiment are contemplated. Any alternatives or modifications which make insubstantial changes in function, in purpose, in structure or in result are intended to be covered by the claims of this patent.

Figure 1:
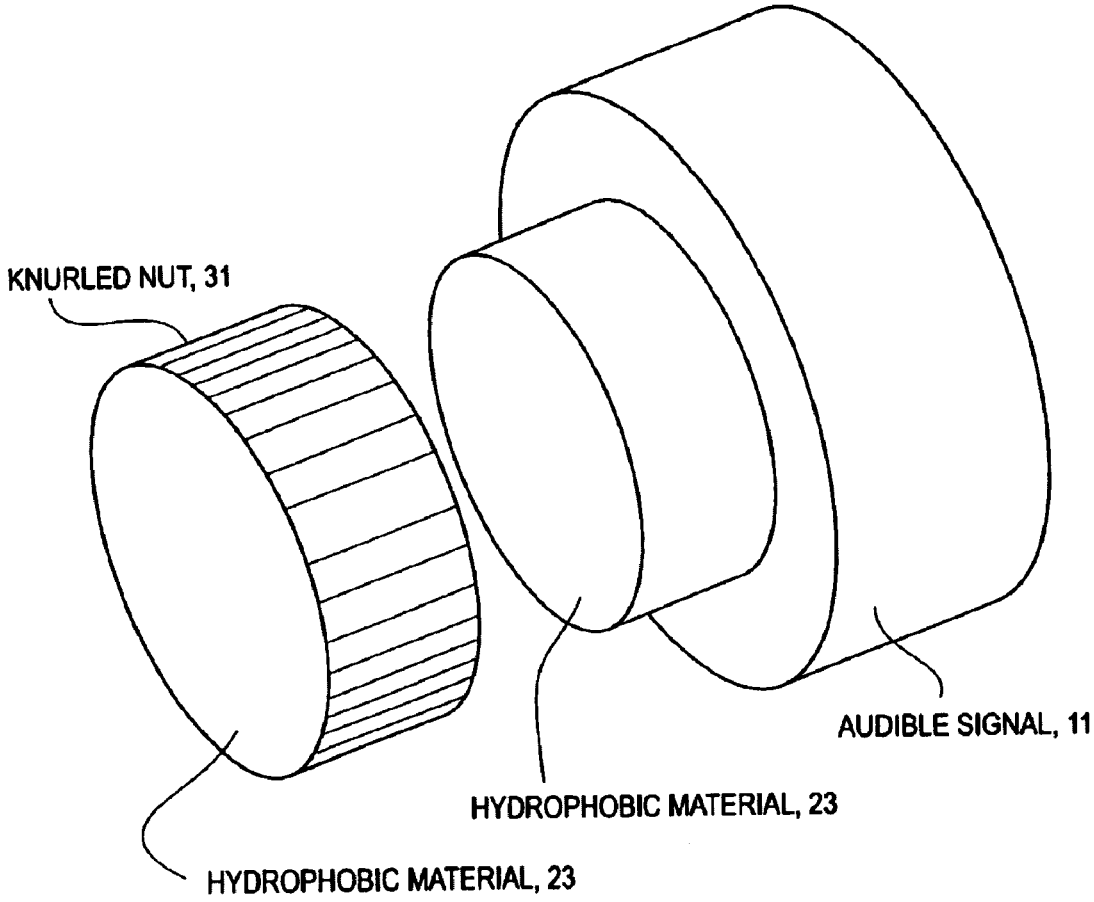
FIG. 1 is an exploded perspective schematic of the improved audible signal in conjunction with a mating knurled nut.
Figure 2:
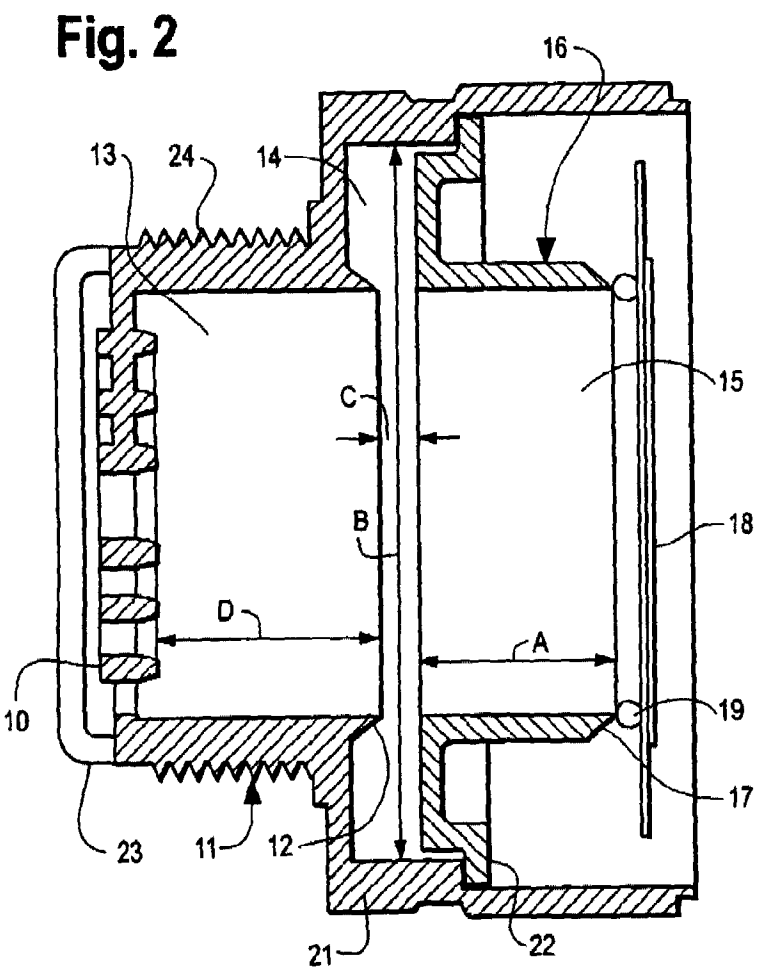
FIG. 2 is a cross-section of the noise-making device including the water resistant barrier of the present invention.

Referring to FIGS. 1 and 2, the present invention is directed to an improved housing and assembly for a piezoelectric transducer. The assembly includes piezoelectric transducer housing 11, having a front grill 10 covered by a hydrophobic barrier 23. The barrier 23, is most preferable made from PTFE, since this material is known to be water resistant, but is not known to affect the sound of the piezoelectric transducer. However, those of ordinary skill in the art having the present teaching in hand will be able to substitute alternative appropriate barriers which have similar sound permeating features. The housing preferably is mated with a knurled nut, 31, for mounting or fastening. The knurled nut 31 is likewise constructed from a similar hydrophobic material, or it can have a hydrophobic barrier 23 which can also act to block liquids from the piezoelectric housing 11. Alternatively, the knurled nut may not cover the front grill when attached to the housing, but might nonetheless be preferably constructed of a hydrophobic material in order to avoid mechanical degradation. The knurled nut preferably mates with the housing 11 by means of a threaded fit, such as the thread 24 shown in FIG. 2.

The hydrophobic barrier 23 is most preferably formed from PTFE which is cut into discs. These discs are attached to the housing by means of a hot melt, sonic weld, silicon adhesive, or other permanent attachment. In an alternative embodiment, the front face or grill 10 of housing 11 might itself be made of PTFE in order to provide water resistant features.

Figure 3:
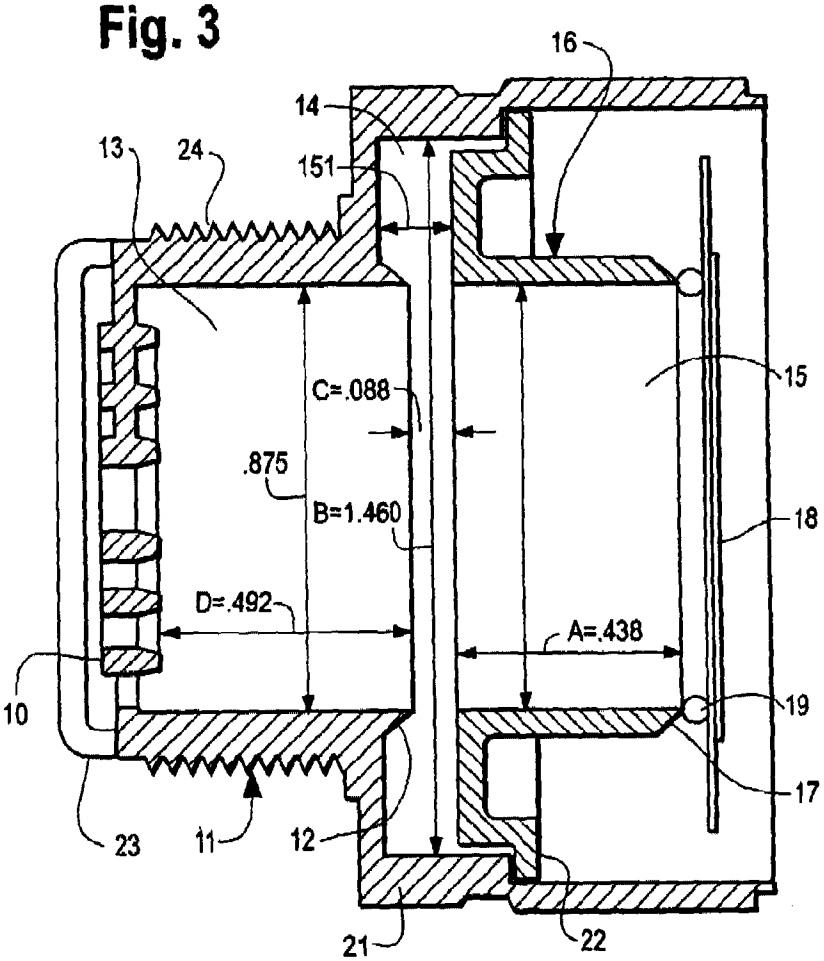
FIG. 3 is another cross-section of the improved noise-making device including the water resistant barrier and dimensions which have been determined to optimize the amplification.

Referring now to FIGS. 2 and 3, the housing is shown to contain a piezoelectric transducer 18. Transducer 18 is mounted at its nodal diameter to a knife-edge 17 at an end of a housing insert 16. Adhesive 19 binds the transducer 18 to the knife-edge 17. Knife-edge 17 supports the transducer 18 while at the same time allowing the transducer to flex when a voltage is applied to it. Mounting the transducer at its nodal diameter minimizes interference with flexing of transducer 18.

Housing insert 16 is cylindrical in cross-section and hollow, forming a sound-amplifying cavity 15 next to the transducer 18. One suitable material for housing insert 16 is 6/6 nylon or "ABS." A source for 6/6 nylon is Zytel 101 available from Pro Tech Plastic Inc., 1295 West Helena Drive, West Chicago, Ill., 60185. The length "A" of housing 16 is adjusted to maximize the amplification.

A main housing 11 is cylindrical in cross-section and hollow. Main housing 11 is attached to an end of housing insert 16. A flange 21 on main housing 11 engages and is secured by any convenient means to a flange 22 on insert 16. Main housing 11 is hollow, and has two cylindrical sections with different diameters. One cylindrical section forms a sound-amplifying cavity 13, and a second larger cylindrical section forms another sound-amplifying cavity 14. The diameters of cavities 13 and 15 are typically about the same, whereas the diameter "B" of cavity 14 is larger. A grill 10 may be attached to the end of housing 11 away from the transducer 18, and allows sound produced by the transducer, and amplified in the cavities, to be emitted and heard.

FIG. 3 shows the invention with dimensions that have been found to produce a sound increase of about 10 to 15 dbA compared to devices using the same transducer and circuitry, but lacking the housing insert 16 and therefore having only one cavity. Dimension "A" is 0.438 inches. Dimension "B" is 1.460 inches. Dimension "C" is 0.088 inches. Dimension "D" is 0.492 inches. The diameters of housing 11 and housing insert 16 are 0.875 inches, approximately the same as the nodal diameter of transducer 18.

The above description is not intended to limit the meaning of the words used in the following claims that define the invention. Rather, it is contemplated that future modifications in structure, function or result will exist that are not substantial changes and that all such insubstantial changes in what is claimed are intended to be covered by the claims. For instance, the preferred embodiment of the present invention focuses upon a hydrophobic PTFE cover attached to the housing—however, the advantages of the present invention could be equally applicable to a wide array of hydrophobic materials, and the invention is likewise intended to cover a housing front face constructed out of such hydrophobic materials. Likewise, it will be appreciated by those skilled in the art that various changes, additions, omissions, and modifications can be made to the illustrated embodiments without departing from the spirit of the present invention. All such modifications and changes are intended to be covered by the following claims.

We claim:

1. A noise-making assembly comprising:

a piezoelectric transducer;

a sound-amplifying housing adjacent the transducer, the sound-amplifying housing enclosing a space communicating with the transducer for receiving sound waves from the transducer, the sound amplifying housing further having a front face, said housing further comprising at least a first cavity, wherein said first cavity is adjacent said piezoelectric transducer and amplifies sounds emitted by the piezoelectric transducer;

a water resistant, sound permeable barrier adjacent to said front face adjacent the first cavity for preventing water from entering the first cavity and affecting the piezoelectric transducer; and a water resistant, hydrophobic fastener, said fastener mating with said sound-amplifying housing adjacent the first cavity for preventing water from entering the first cavity and affecting the piezoelectric transducer;

wherein the water resistant sound permeable barrier is constructed of polytetrafluoroethylene.

2. The noise making assembly of claim 1, wherein the water resistant, sound permeable barrier is attached to the front face by a sonic weld.

3. The noise making assembly of claim 1, wherein the water resistant, sound permeable barrier is attached to the front face by a hot melt.

4. The noise making assembly of claim 1, wherein the water resistant, sound permeable barrier is attached to the front face by a silicone adhesive.

5. The noise making assembly of claim 1, wherein the water resistant sound permeable barrier is integrally attached to said water resistant, hydrophobic fastener.

6. The noise making assembly of claim 1, wherein the water resistant, hydrophobic fastener threadingly engages said sound-amplifying housing.

7. The noise making assembly of claim 1, wherein the front face of said sound amplifying housing includes at least one aperture.

8. The noise making assembly of claim 1, wherein the front face of said sound amplifying housing comprises a grill.

9. The noise making assembly of claim 1, wherein the front face of said sound amplifying housing is constructed of polytetrafluoroethylene.

10. The noise-making assembly of claim 1, further comprising a second cavity adjacent the first cavity, wherein the second cavity further amplifies sounds emitted by the piezoelectric transducer.

* * * * *